US006637612B2

(12) United States Patent
Maczek

(10) Patent No.: US 6,637,612 B2
(45) Date of Patent: Oct. 28, 2003

(54) CONTAINER WITH IMPROVED BOTTOM RECESS

(75) Inventor: Elizabeth Maczek, Mount Prospect, IL (US)

(73) Assignee: Consolidated Container Company, Atlanta, GA (US)

( * ) Notice: Subject to any disclaimer, the term of this patent is extended or adjusted under 35 U.S.C. 154(b) by 0 days.

(21) Appl. No.: 10/105,988

(22) Filed: Mar. 25, 2002

(65) Prior Publication Data

US 2003/0178386 A1 Sep. 25, 2003

(51) Int. Cl.[7] ..... B65D 1/42

(52) U.S. Cl. ..... 215/373; 215/370; 220/606

(58) Field of Search ..... 215/370, 373, 215/374; 220/606, 608

(56) References Cited

U.S. PATENT DOCUMENTS

| | | | | |
|---|---|---|---|---|
| 3,737,066 A | * | 6/1973 | Ames | 220/834 X |
| 3,917,095 A | * | 11/1975 | Seefluth | 215/373 X |
| 4,502,607 A | | 3/1985 | Szajna | |
| 5,205,444 A | * | 4/1993 | Polhemus | 222/472 |
| 5,269,437 A | * | 12/1993 | Gygax | 215/373 X |
| 6,202,904 B1 | * | 3/2001 | Casciano | 222/567 |

* cited by examiner

*Primary Examiner*—Sue A. Weaver
(74) *Attorney, Agent, or Firm*—Sonnenschein, Nath & Rosenthal LLP

(57) ABSTRACT

A container bottom for minimizing deformnation. An outer rounded portion, an inner recessed portion, being generally ellipse shaped, and an offset portion extending along the inner recessed portion are adapted to minimize bulging caused by increased ambient temperature and pressure gradients to provide an improved container to store non-liquid goods.

27 Claims, 6 Drawing Sheets

CONTAINER WITH IMPROVED BOTTOM RECESS

BACKGROUND OF THE INVENTION

The present invention relates to containers. In particular, the invention relates to plastic molded containers used to store dry foodstuffs.

Presently, some foodstuffs are packaged, shipped and sold in plastic containers. These containers, however, can become distorted when exposed to pressure gradients. For example, when shipped over different elevations, such as mountainous regions, the pressure difference associated with the different elevations creates distortion of these containers.

Accordingly, pressure gradients are a factor when foodstuffs are sealed in a container at a low elevation and shipped to a higher elevation. The pressure differentials associated with less outside pressure in higher elevations and the internal container pressure can cause the container to distort and bulge.

These containers also distort upon exposure to elevated ambient temperatures. For example, when shipped or stored in a elevated temperature environment, the increased temperature causes the internal container pressure to rise. Accordingly, the elevated pressure can cause the container to distort and bulge.

Further, in today's fast paced society, consumers typically consume these food snacks while performing other activities such as driving and working. Accordingly, consuming these snacks in an easy to handle container becomes important for the consumer. Additionally, consuming these snacks in a container which does not bulge and subsequently tip over in a heated ambient environment becomes necessary in maintaining a convenient and clean eating situation.

Dry snack food containers typically comprise bag-shaped flexible packages that must be torn open in order to handle the food substance. A problem associated with these types of food packages is the difficulty in grasping and opening these packages. While performing other activities, the consumer is not paying attention to the package resulting in mishandling of these types of packages. Further, these packages tend to split fully apart spilling the contents leading to a messy condition. Accordingly, these types of packages are not conducive for eating while performing activities such as driving. Further, these packages are not configured to fit into the cup holders typically used for drinks in vehicles.

Other food containers relate to bottles which store liquid substances such as soda. Since, the bottle contains a liquid, the bottle is relatively stable due to the relative high volume of the contained liquid. Accordingly, the bottle incorporates feet or a uniform circular bearing surface to support the bottle in the upright position.

This bottle container contains deficiencies, however, for dry snack food. During a pressure and/or temperature change that occurs in transportation or sitting outdoors, the bottle with a dry snack food would deform and become unstable. Accordingly, because of the large volume to product ratio associated with a light dry food substance contained within this type of container, the bottle would tip over or lean due to bulging of the bottom experienced in pressure and/or temperature gradients.

A need therefore exists to hold dry food snacks in a container that will not become deformed and unstable due to an increase in ambient temperature. A need also exists to hold dry food snacks in a container that will resist deformation when exposed to different pressure gradients. The solution however must eliminate feet commonly associated with a plastic bottle to provide a balanced container for dry food snacks because generally food containers have a higher center of gravity due to smaller effective surface diameter reducing their stability in filling operations and in distribution.

Further, a need exists to hold dry food snacks in a container that can easily be held by the user while the user performs other activities. The solution however must fit tightly into a vehicle cup holder. The solution must also stand unassisted on a surface such as a desk so the user can conveniently clutch the container with one hand while using the other for another purpose. Additionally, the container must stand upright on a store shelf. A container that leans from its intended vertical orientation creates a consumer perception of poor quality or damaged goods, causing the consumer to be less likely to purchase the package.

SUMMARY OF THE INVENTION

The present invention provides to a container with an improved bottom which resists deformation that would otherwise cause a container to tip. To that end, the invention provides a container with an improved bottom that remains standing unassisted while exposed to temperature and pressure gradients.

The present invention relates to a container with an improved bottom, in particular, a plastic molded container bottom, that does not tip over but remains standing while exposed to elevated ambient temperatures by resisting bulging caused by the increased temperature. The container bottom also resists deformation when exposed to pressure gradients. Described in the accompanying drawings and following text is a container bottom that is used for containers holding non-liquid food substances such as dry snack food.

In an embodiment, the present invention provides a container bottom that comprises an outer portion having a diameter, an inner recessed portion and an offset portion wherein these portions are adapted to minimize deformation due to at least one environmental condition such as an increased ambient air temperature and/or a pressure gradient. The inner recessed portion comprises an outer ellipse portion and an inner ellipse portion wherein the inner recessed portion is recessed within the outer ellipse portion and includes a first major half and a second major half and a first minor half and a second minor half. In this embodiment, the portions are related by a predetermined proportion to prevent the deformation and bulging caused by the increased ambient temperature and/or pressure gradient. There dimensions assist in keeping the container in the intended vertical orientation.

In an embodiment, the outer portion is rounded and includes a radius of curvature.

In an embodiment, the inner recessed portion comprises an outer ellipse portion and an inner ellipse portion wherein the inner recessed portion is recessed within the outer ellipse portion.

In an embodiment, the first minor half and the second minor half are proportionally related to a diameter of the container bottom.

In an embodiment, the present invention provides a container bottom that comprises an outer portion having a radius of curvature. Additionally, the embodiment provides an inner recessed portion formed within the outer portion wherein the inner recessed portion is generally ellipse shaped having an outer ellipse portion and an inner ellipse portion recessed within the outer ellipse portion.

In an embodiment, the present invention provides a container bottom that comprises an outer portion having a radius of curvature. Additionally, the embodiment provides an inner recessed portion formed within the outer portion wherein the inner recessed portion is generally ellipse shaped having an outer ellipse portion and an inner ellipse portion recessed within the outer ellipse portion. Further the recessed inner portion is related by a predetermined proportion to the radius of the outer portion.

In an embodiment, the radius of curvature is proportionally related to the outer ellipse portion.

In an embodiment, the invention provides a container which resists deformation while exposed to elevated ambient temperatures and pressure gradients. The embodiment provides an outer rounded portion having a diameter equivalent to sidewalls of the container.

The embodiment further provides an inner recessed portion formed within the outer rounded portion wherein the inner recessed portion is generally ellipse shaped having an outer ellipse portion and an inner ellipse portion. The inner ellipse portion has a first minor half and a second minor half forming a bottom portion wherein the first minor half and the second minor half are related by a predetermined proportion to the diameter. The embodiment further provides an offset portion positioned offset from the bottom portion to form a rib extending in the direction of the inner ellipse portion.

In an embodiment, the container holds non-liquid material such as dry food snacks.

In an embodiment, a radius of curvature of the outer rounded portion is defined by the length of the inner ellipse portion.

An advantage of the present invention is to provide an improved container bottom which does not become deformed and unstable during elevated ambient temperatures and/or pressure gradients.

Another advantage of the present invention is to minimize bulging caused by elevated ambient temperatures.

Another advantage of the present invention is to resist deformation caused by pressure gradients.

Another advantage of the present invention is to keep the container in the intended vertical orientation.

Another advantage of the present invention is to provide a container to store non-liquid material such as dry food snacks.

Another advantage of the present invention is to provide a container for dry food snacks which is easy to handle while performing other activities.

DETAILED DESCRIPTION OF THE PRESENTLY PREFERRED EMBODIMENTS

The present invention is presently useful as a plastic molded container with an improved bottom which is stable when exposed to relatively elevated ambient temperatures and/or pressure gradients. In particular, the invention provides for a container bottom which minimizes bulging and resists deformation of the bottom of a sealed container caused when the container is exposed to temperature and/or pressure gradients. Accordingly, the container remains in the intended vertical orientation.

In the embodiment described next, the present invention provides a container bottom which improves the use and adaptability of a container for non-liquid materials such as dry food substances. Accordingly, the present invention provides such a container bottom which increases the use, stability and convenience of a container which holds food substances such as dry snack foods which leads to consumer satisfaction and preference.

Figure 1:
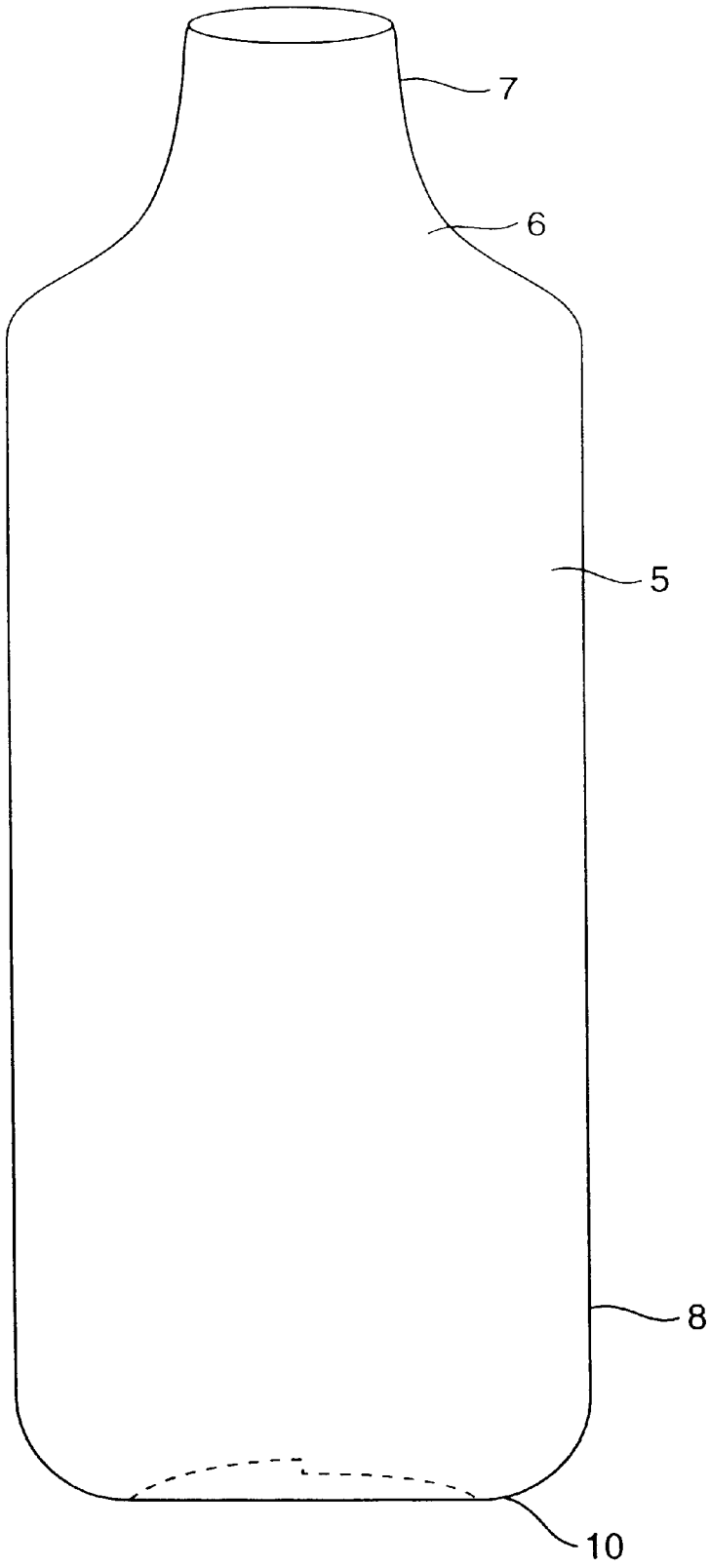
FIG. 1 is a side elevational view of a container that can embody principles of the invention.
Figure 8:
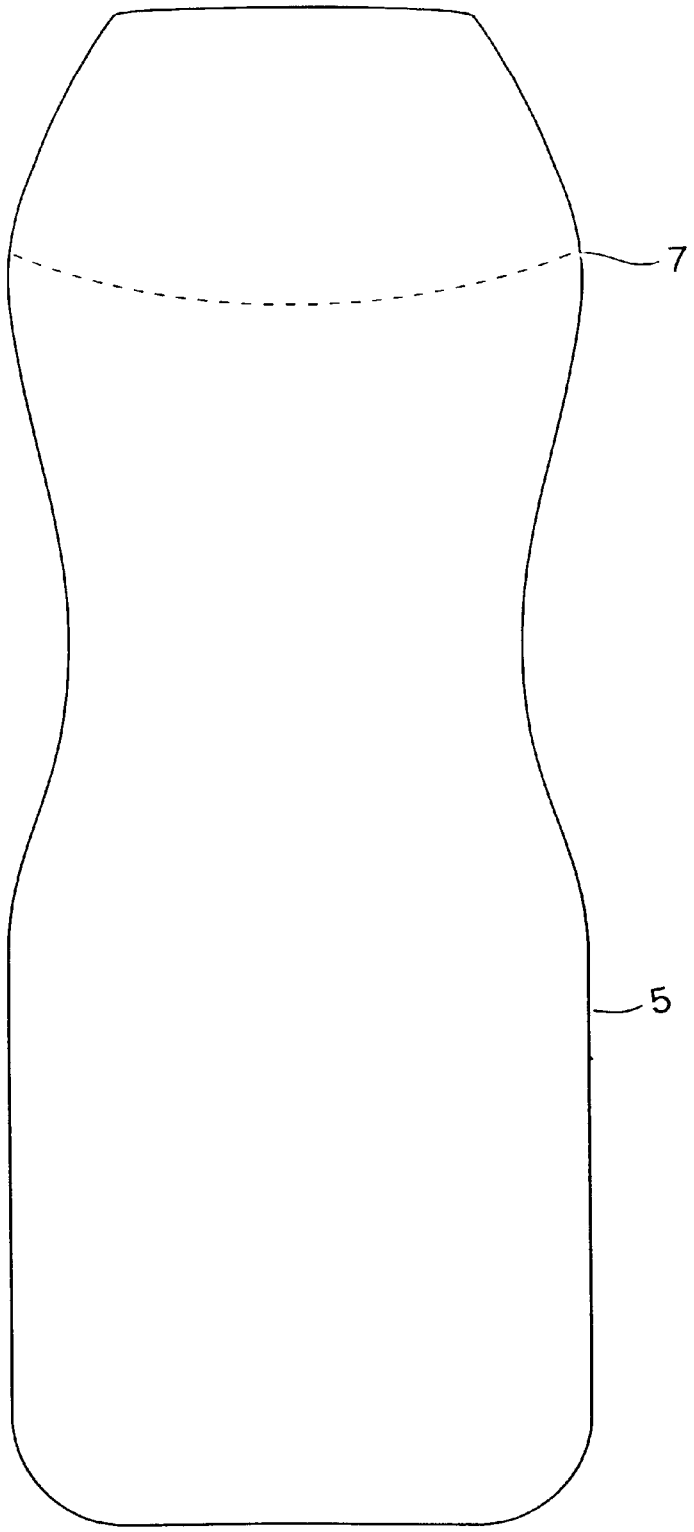
FIG. 8 is a side elevational view of a container that can embody principles of the invention.

FIG. 1 illustrates a container 5 in a side elevational view. As illustrated, the container 5 includes an upper portion 6 including a neck 7 and a lower portion 8 including a container bottom 10. The neck 7 is shown in FIG. 1 for illustration purposes and may incorporate other shapes and sizes known in the art. The neck 7 may include other shapes, such as but not limited to, ajar or cylinder. FIG. 8 illustrates a neck 7 having a cylinder shape. Returning to FIG. 1, the container bottom 10 can be specifically configured in accordance with the invention as described next.

Figure 2:
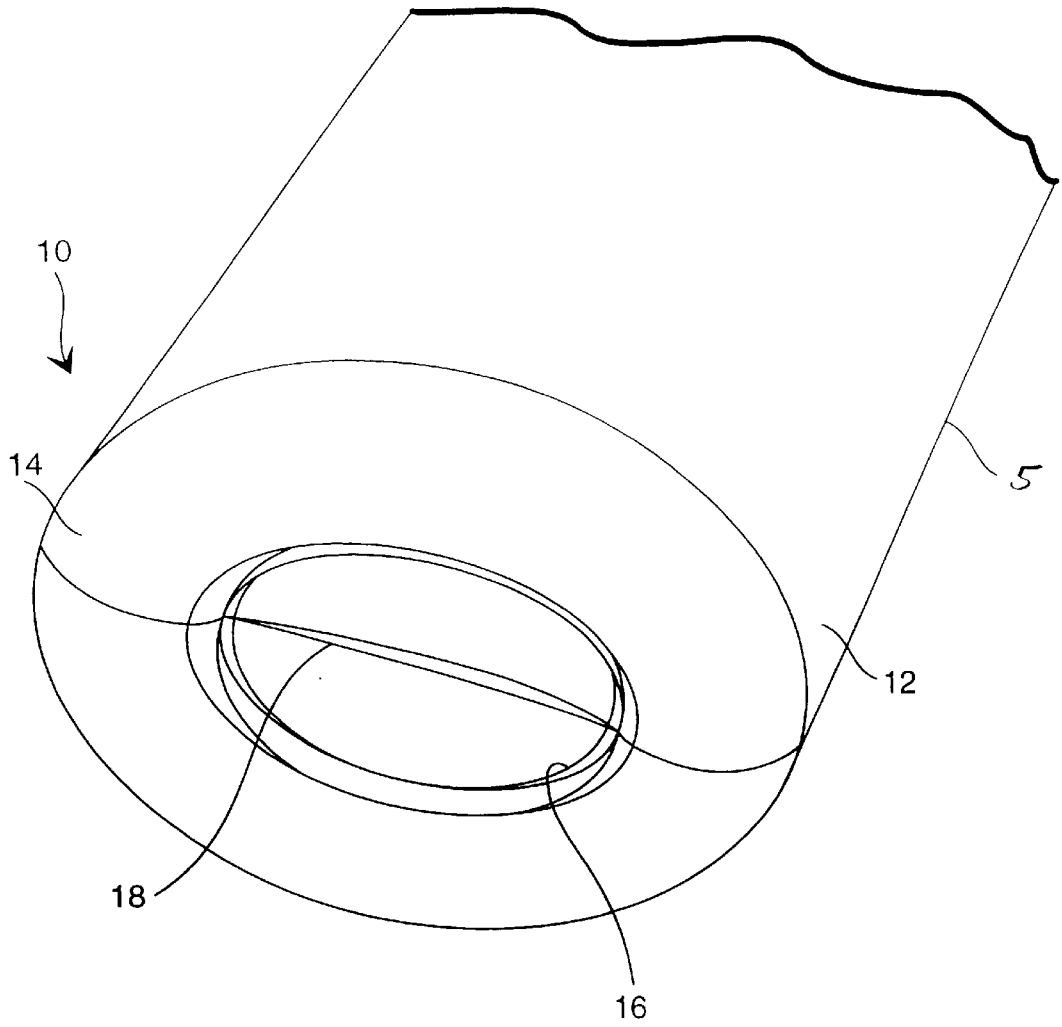
FIG. 2 is a perspective view of a lower portion of the container of FIG. 1.

FIG. 2 illustrates a perspective view of an exemplary container bottom 10. As shown in FIG. 2, the container bottom 10 comprises a base 12 having an outer portion 14, an inner recessed portion 16 and an offset portion 18. The outer portion 14 may incorporate different configurations such as circular, square or elongated configurations wherein the illustrated embodiment shows the outer portion 14 as a circular cross section.

Through extensive research and testing, the outer portion 14, the inner recessed portion 16 and the offset portion 18 combine to form the container bottom 10 wherein the container bottom 10 is configured to minimize deformation when exposed to elevated ambient temperature such as temperatures experienced in the summer months. Additionally, the container bottom 10 is configured to resist deformation when exposed to pressure gradients such as those gradients experienced during shipping. Accordingly, the present invention allows a container 5 to resist deformation and to remain stable in changing environmental conditions that increase internal pressure subsequent to the neck 7 being sealed.

The present invention provides an excellent improvement to a container 5 to hold dry food substances. Additionally, the present invention provides a container 5 that will not tip over from bulging when the container is exposed to relatively elevated ambient temperatures and/or pressure differentials. Further, the present invention provides a container 5 for dry snack food conducive for the consumer to clutch for use.

Figure 3:
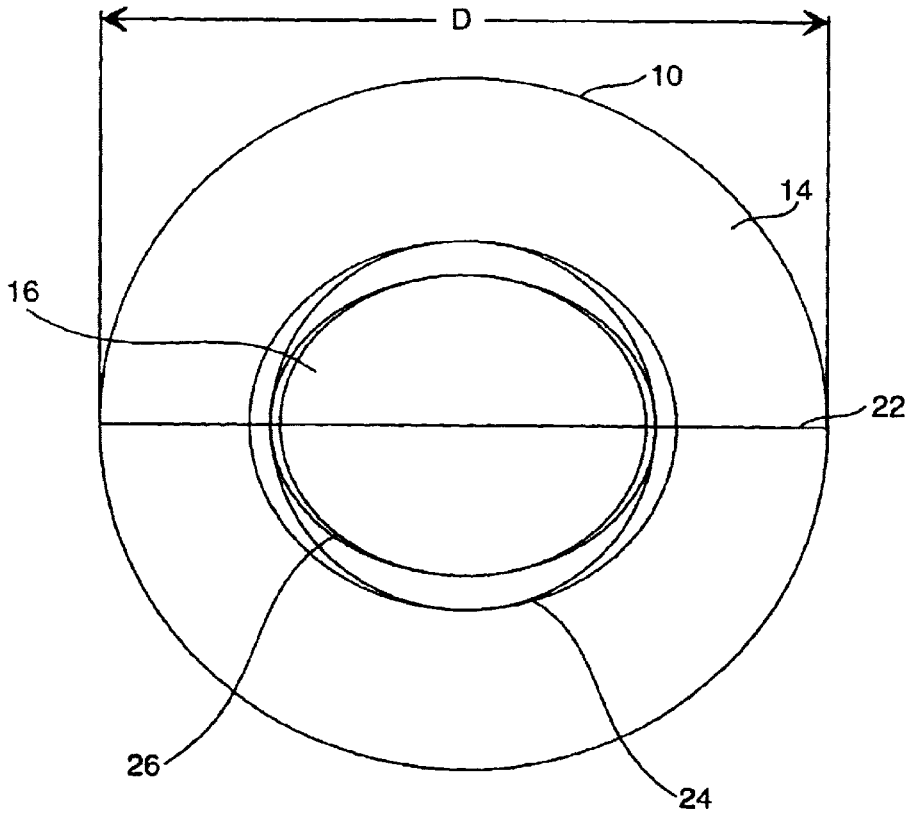
FIG. 3 is a bottom view of the bottom of the container of FIG. 1.

Turning to FIG. 3, the container bottom 10 is shown with the offset portion 18 removed for clarity in describing the invention wherein a diameter 22 of the container bottom 10 is shown. As shown in FIG. 3, the inner recessed portion 16 is formed within the outer portion 14. The inner recessed portion 16 is generally oval or ellipse shaped having an outer ellipse portion 24 and an inner ellipse portion 26. The inner ellipse portion 26, being positioned within the outer ellipse portion 24, is smaller than the outer ellipse portion 24 and further extends into the container bottom 10.

Figure 4:
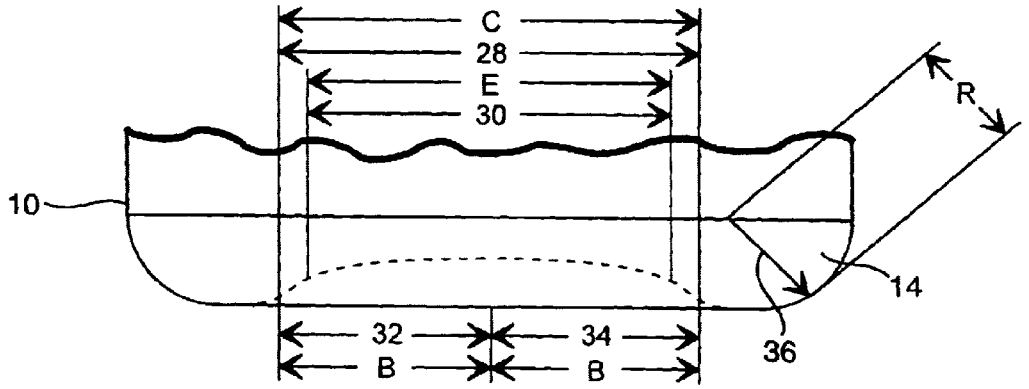
FIG. 4 is a first partial side elevational view of the container of FIG. 1

Referring to FIG. 4, a cross section of the container bottom 10 is shown with the offset portion 18 removed for clarity. As shown, the outer ellipse portion 24 (shown in FIG. 3), includes an outer major diameter 28 while the inner ellipse portion 26 (shown in FIG. 3) includes an inner major diameter 30 wherein the inner major diameter 30 is smaller than the outer major diameter 28. The inner major diameter 30 is split into halves into a first major half 32 and a second major half 34. Additionally, as shown in FIG. 4, the outer portion 14 includes a radius 36 of curvature, the relationship of which will described in detail below.

Figure 5:
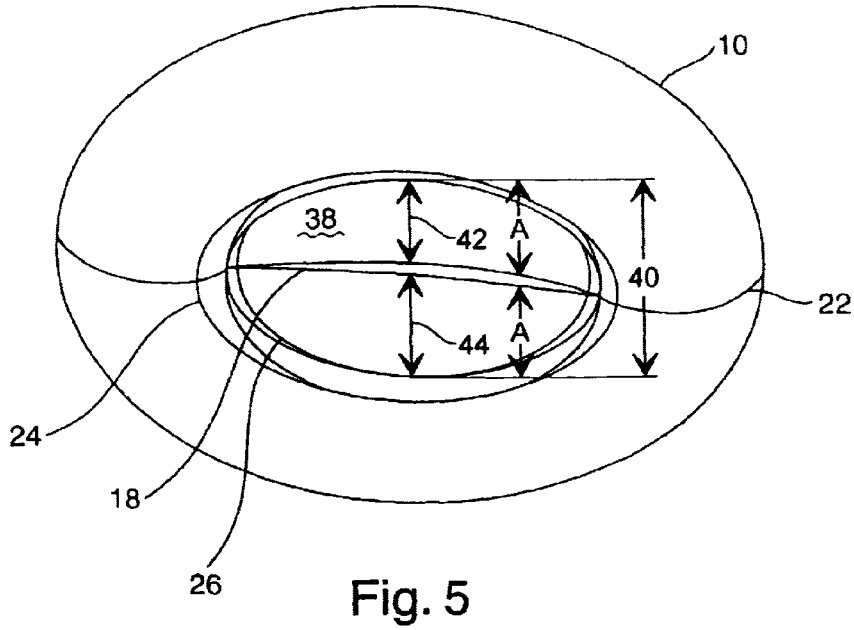
FIG. 5 is a perspective view of the container bottom of the container of FIG. 1.

Turning to FIG. 5, the container bottom 10 is shown with the offset portion 18 positioned in the inner ellipse portion 26. To minimize bulging, the inner ellipse portion 26 is recessed into the container bottom 10 wherein the inner ellipse portion 26 is recessed from the outer ellipse portion 24. Accordingly, the inner ellipse portion 26 forms a bottom portion 38 for the container bottom 10. The inner ellipse portion 26 further includes an inner minor diameter 40 formed by a first minor half 42 and a second minor half 44 wherein the first minor half 42 and the second minor half 44 are positioned opposite of each other.

Figure 6:
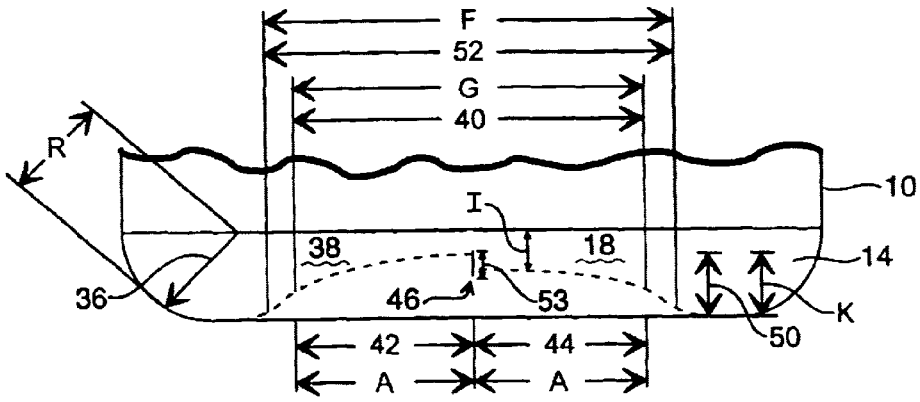
FIG. 6 is a second partial side elevational view of the container of FIG. 1.

In accordance with the invention, the bottom portion 38 includes the offset portion 18 as shown in FIG. 6. The offset portion 18 extends longitudinally along the bottom portion 38. Accordingly, the offset portion 38 extends within the inner ellipse portion 26 (shown in FIG. 5) to form a rib 46 that extends along the bottom portion 38. In the illustrated embodiment, the second minor half 44 extends below the bottom portion 38 and the first minor half 42 to form the offset portion 18 as shown in FIG. 6. It should be known that the first minor half 42 could also extend below the bottom portion 38 and the second minor half 44 to form the offset portion 18.

By forming the rib 46 between the first minor half 42 and the second minor half 44 and by recessing the inner recessed portion 16, the rib 46 does not bottom out under the load present in the container 5. Accordingly, the container bottom 10 minimizes bulging of the outer portion 14. Further, by stiffening the bottom portion 38, the sidewalls 48 of the container 5 (shown in FIG. 7) may be reduced in thickness resulting in reduced manufacturing costs. The rib 46 may incorporate an extension (not shown) inside the container 5 as disclosed in U.S. Pat. No. 4,502,607 incorporated herein.

Referring back to FIGS. 4, 5 and 6, the present invention incorporates dimensional relationships in order to provide a novel container to hold non-liquid substances such as snack foods. These dimensional relationships provide a container 5 that resists bulging when exposed to elevated ambient temperatures and pressure gradients. The dimensional relationships further provide a container 5 that is easy to clutch, hold and pour the non-liquid goods into the user's mouth. Additionally, the dimensional relationships also provide a stable container 5 that will rest unassisted on many surfaces. The dimensional relationships also provide that the container 5 will easily configure to enclosures such as a cup holder commonly found in vehicles.

Referring to FIG. 5, the lengths of the first minor half 42 and the second minor half 44 as measured from inner ellipse portion 26 to the offset portion 18 is related to the diameter 22 of the container 5. This relationship is satisfied by General Formula 1 wherein the dimension of the either the first minor half 42 and the second minor half 44 is denoted by "A" and the diameter 22 of the container 5 is denoted by "D".

General Formula 1 states: $A=Y\times D$, wherein Y is satisfied by the range $0.18\leqq Y\leqq 0.22$. Thus, the dimension of the first minor half 42 and the second minor half 44 of the present invention will provide the benefits of the present invention based on the range of dimensions of the diameter 22.

Referring to FIG. 4, the dimensions of the first major half 32 and the second major half 34, in turn, are in relation to the dimension of the first minor half 42 or the second minor half 44 (shown in FIG. 5). This relationship is satisfied by General Formula 2 wherein the dimension of the first minor half 42 or the second minor half 44 is denoted by "A" and the dimension of either the first major half 32 and the second major half 34 is denoted by "B".

General Formula 2 states: $B=Y\times A$, wherein Y is satisfied by the range $1.15\leqq Y\leqq 145$. Thus, the dimension of the first major half 32 and the second major half 34 of the present invention will provide the benefits of the present invention based on the range of dimensions of the first minor half 42 or the second minor half 44.

Referring to FIG. 6, the dimension of the recessed height 50 of the bottom portion 38 as measured from bottom of the outer portion 14, is in relation to the dimension of the first minor half 42 or the second minor half 44 denoted by "A" (shown in FIG. 5) in the following equation. This relationship is satisfied by General Formula 3 wherein the dimension of the recessed height 50 is denoted by "H".

General Formula 3 states: $H=Y\times A$, wherein Y is satisfied by the range $0.35\leqq Y\leqq 0.45$. Thus, the dimension of the recessed height 50 of the present invention will provide the benefits of the present invention based on the range of dimensions of the first minor half 42 or the second minor half 44.

As shown in FIG. 6, the height 53 of the rib 46 of the offset portion 18 is in relation to the dimension of the first minor half 42 or the second minor half 44 denoted by "A" (shown in FIG. 5) in the following equation. This relationship is satisfied by General Formula 4 wherein the dimension of the offset portion 18 is denoted by "I".

General Formula 4 states: $I=Y\times A$, wherein Y is satisfied by the range $0.045\leqq Y\leqq 0.125$. Thus, the height 53 of the rib 46 of the present invention will provide the benefits of the present invention based on the range of dimensions of the first minor half 42 or the second minor half 44.

Referring to FIG. 4, the radius 36 of curvature of the outer portion 14 is also dependent upon dimensions of the other elements of the present invention. The dimension of the radius 36 is in relation to the dimension of the first major half 32 in addition to the second major half 34 resulting in the inner major diameter 30 denoted by "E" in the following equation. This relationship is satisfied by General Formula 6 wherein the dimension of the radius 36 is denoted by "R".

General Formula 6 states: $R=Y\times E$, wherein Y is satisfied by the range $0.25\leqq Y\leqq 0.75$. Thus, the dimension of the radius 36 of the present invention will provide the benefits of the present invention based on the range of dimensions of the inner major diameter 30.

Referring to FIG. 4, the radius 36 of curvature of the outer portion 14 is also dependent upon dimensions of the other elements of the present invention. The dimension of the radius 36 is in relation to the dimension of the first major half 32 in addition to the second major half 34 resulting in the inner major diameter 30 denoted by "D" in the following equation. This relationship is satisfied by General Formula 6 wherein the dimension of the radius 36 is denoted by "R".

General Formula 6 states: $R=Y\times D$, wherein Y is satisfied by the range $0.25\leqq Y\leqq 0.75$. Thus, the dimension of the radius 36 of the present invention will provide the benefits of the present invention based on the range of dimensions of the inner major diameter 30.

Referring to FIG. 6, the radius 36 of curvature of the outer portion 14 is also dependent in relation to the dimension of the outer minor diameter 52 denoted by "F" in the following equation. This relationship is satisfied by General Formula 7 wherein the dimension of the radius 36 is denoted by "R".

General Formula 7 states: $R=Y\times F$, wherein Y is satisfied by the range $0.25\leqq Y\leqq 0.75$. Thus, the dimension of the radius 36 of the present invention will provide the benefits of the present invention based on the range of dimensions of the outer minor diameter 52.

Referring to FIG. 6, the radius 36 of curvature of the outer portion 14 is also dependent upon dimensions of the other elements of the present invention. The dimension of the radius 36 is in relation to the dimension of the first minor half 42 in addition to the second minor half 44 resulting in the inner minor diameter 40 denoted by "G" in the following equation. This relationship is satisfied by General Formula 8 wherein the dimension of the radius 36 is denoted by "R".

General Formula 8 states: $R=Y\times G$, wherein Y is satisfied by the range $0.30\leqq Y\leqq 0.90$. Thus, the dimension of the radius 36 of the present invention will provide the benefits of the present invention based on the range of dimensions of the inner minor diameter 40.

Figure 7:
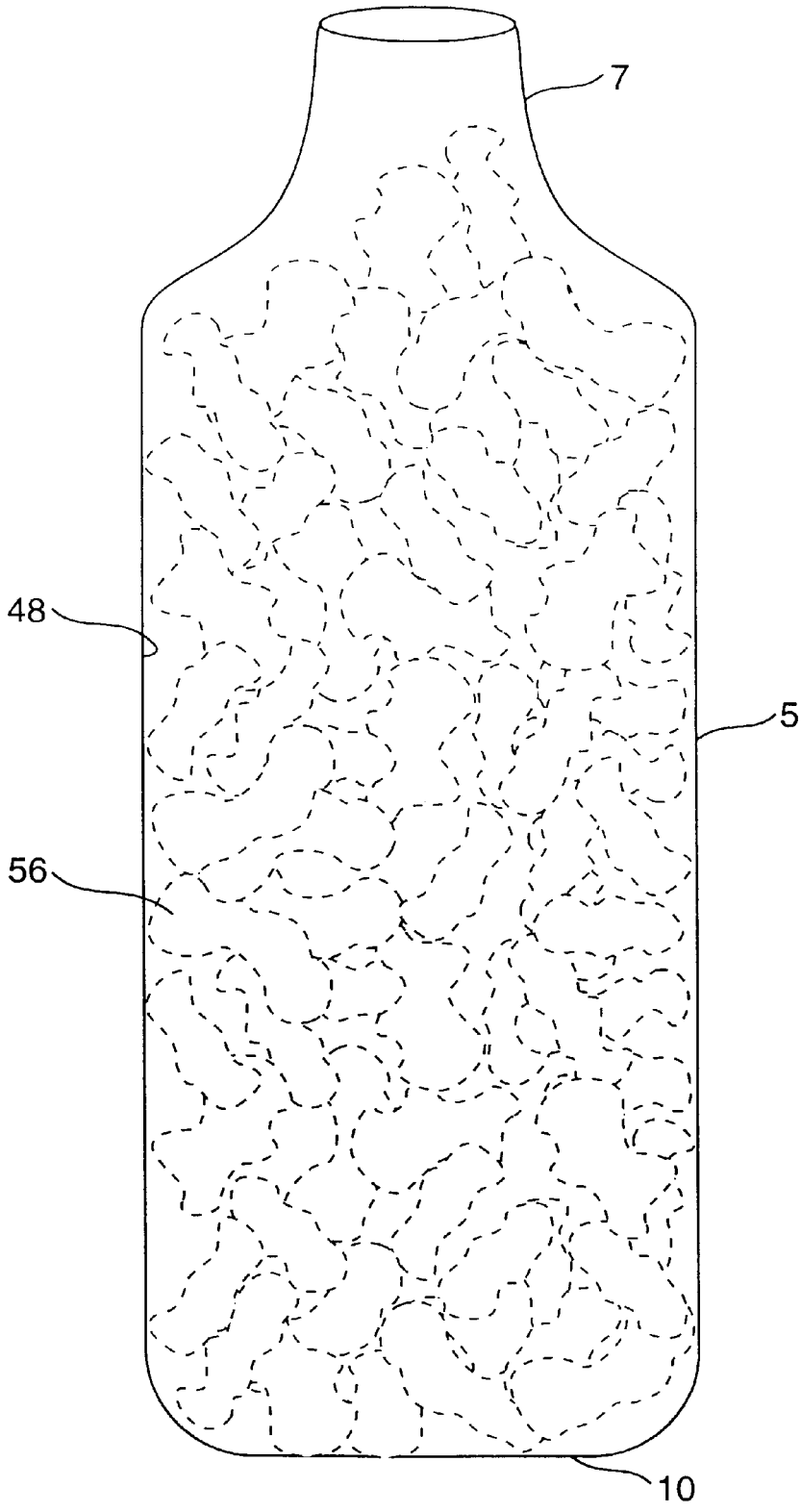
FIG. 7 is a side elevational view of a container containing dry foodstuffs.

Turning to FIG. 7, the illustrated embodiment shows the present invention embodied in the container 5. The container bottom 10 is shown with the container 5 wherein the container includes sidewalls 48 and the neck 7. The present invention is adapted to store non-liquids goods for ready for consumption. In the illustrated embodiment, the present invention is shown storing dry goods 56 such as snack foods. The gas or air space fills approximately 80% of the volume of the container 5 while the dry goods 56 fills the remaining approximate 20% of the volume of the container 5.

The present invention performs superior during temperature and pressure testing compared with other blow molded containers due to the dimensional relationships of the outer portion 14, the outer ellipse portion 24, inner ellipse portion 26, the offset portion 18, the diameter 22, and the radius 36. Accordingly, during testing, the present invention was tested and found to withstand considerably greater pressure gradients at elevated temperatures than conventional blow molded containers.

During testing, at 70° F., conventional blow molded containers failed at the equivalent pressure of approximately 4,500 feet increase in elevation. The present invention, however, failed at the equivalent pressure of approximately 12,500 feet increase in elevation.

During testing, at 100° F., conventional blow molded containers failed at the equivalent pressure of approximately 1,500 feet increase in elevation. The present invention, however, failed at the equivalent pressure of approximately 9,500 feet increase in elevation.

As previously discussed, the container bottom 10 is primarily intended for use in a bottom or other container of a circular cross section. However, the present invention may also be used in conjunction with a bottle or container of other cross section such as an elongated cross section known in the art. Further, turning to FIG. 8, the present invention may also be used in conjunction with a bottle or container having a jar or cylinder shape or any shape known in the art. In this embodiment of FIG. 8, the container 5 is curved shaped for enhanced gripping by the user. This embodiment may also incorporate a removable top which is sized to fit around the container bottom 10. Accordingly, while opened, the top can be conveniently stored under the container 5. This configuration will also fit into a car cup holder.

The exemplary embodiments described herein are provided merely to illustrate the principles of the invention and should not be construed as limiting the invention. The specification and drawings are, accordingly, to be regarded in an illustrative. Moreover, the principles of the invention may be applied to achieve the advantages described herein and to achieve other advantages or to satisfy other objectives, as well.

Accordingly, due to the shape of the outer portion 14 and the inner recessed portion 16 and the offset portion 18, the present invention provides a novel container to hold dry food substances. Further, due to the dimensional relationship of the radius 36, the outer major diameter and inner major diameter 30, the present invention provides an improved container bottom 10 that resists bulging and deformation when exposed to temperature and pressure gradients. Accordingly, the container bottom 10 will remain in the intended vertical orientation and not tip over. Further, due to the dimensional relationships, the container bottom 10 is conducive to use in a cup holder typically found in most vehicles.

Although modifications and changes may be suggested by those skilled in the art, it is the intention of the inventors to embody within the patent warranted hereon all changes and modifications as reasonably and properly come within the scope of their contribution to the art.

I claim:

1. A container having a container bottom, the bottom comprising:

an outer portion, the outer portion having a diameter;

an inner recessed portion formed within the outer portion, the inner recessed portion being generally ellipse shaped and having an outer ellipse portion and an inner ellipse portion, the inner ellipse portion having a first minor half and a second minor half such that the first minor half and the second minor half are related by a predetermined proportion to the diameter; and an offset portion, the offset portion being axially offset from and extending along the inner recessed portion, wherein the offset portion and the predetermined proportion of the first minor half, the second minor half and diameter are configured to minimize deformation due to at least one environmental condition.

2. The container according to claim 1, wherein the outer portion is rounded.

3. The container according to claim 1, wherein the outer portion includes a radius of curvature.

4. The container according to claim 1, wherein the inner ellipse portion is recessed within the outer ellipse portion.

5. The container according to claim 1, wherein the outer ellipse portion includes an outer major diameter and outer minor diameter.

6. The container according to claim 5, wherein the radius is proportionally related to the outer major diameter by the equation $R=Y\times C$, wherein R represents the radius, C represents the outer major diameter and Y is satisfied by the range $0.21\leqq Y\leqq 0.63$.

7. The container according to claim 5, wherein the radius is proportionally related to the outer minor diameter by the equation R=Y×F, wherein R represents the radius, F represents the outer minor diameter and Y is satisfied by the range $0.25 \leqq Y \leqq 0.75$.

8. The container according to claim 1, wherein the inner ellipse portion includes an inner major diameter and an inner minor diameter.

9. The container according to claim 8, wherein the radius is proportionally related to the inner major diameter by the equation R=Y×E, wherein R represents the radius, E represents the inner major diameter and Y is satisfied by the range $0.25 \leqq Y \leqq 0.75$.

10. The container according to claim 8, wherein the radius is proportionally related to the inner minor diameter by the equation R=Y×G, wherein R represents the radius, G represent the inner minor diameter and Y is satisfied by the range $0.30 \leqq Y \leqq 0.90$.

11. The container according to claim 1, wherein the inner ellipse portion includes a first major half and a second major half.

12. The container according to claim 11, wherein the first major half and second major half are proportionally related to the first minor half or the second minor half by the equation B=Y×A, wherein B represents the first major half or the second major half, A represents the first minor half or the second minor half and Y is satisfied by the range $1.15 \leqq Y \leqq 1.45$.

13. The container according to claim 1, wherein the first minor half and second minor half are proportionally related to the diameter by the equation A=Y×D, wherein A represents the first minor half or the second minor half, D represents the diameter and Y is satisfied by the range $0.18 \leqq Y \leqq 0.22$.

14. The container according to claim 1, wherein a recessed height of the bottom portion is proportionally related to the first minor half or the second minor half by the equation H=Y×A, wherein H represents the recessed height, A represents the first minor half or the second minor half and Y is satisfied by the range $0.35 \leqq Y \leqq 0.45$.

15. The container according to claim 1, wherein a height of the offset portion is proportionally related to,the first minor half or the second minor half by the equation I=Y×A, wherein I represents the height, A represents the first minor half or the second minor half and Y is satisfied by the range $0.045 \leqq Y < 0.125$.

16. A container bottom, comprising:

an outer portion having a radius of curvature;

an inner recessed portion formed within the outer portion wherein the inner recessed portion is related by a predetermined proportion to the radius of the outer portion, the inner recessed portion being generally ellipse shaped having an outer ellipse portion and an inner ellipse portion, the inner ellipse portion being recessed within the outer ellipse portion; and an offset portion axially offset from the inner ellipse portion, the offset portion forming a rib extending in the direction of the inner ellipse portion to prevent deformation of the container bottom.

17. The container bottom according to claim 16, wherein the radius of curvature is proportionally related to the outer ellipse portion.

18. The container bottom according to claim 16, wherein the radius of curvature is proportionally related to the inner ellipse portion.

19. The container bottom according to claim 16, wherein the offset portion is elongated in the direction of the inner recessed portion.

20. The container bottom according to claim 16, wherein the container bottom is below molded plastic.

21. A plastic molded container having a top, sidewalls and a bottom which resists deformation during elevated ambient temperatures and pressure gradients, comprising:

an outer rounded portion having a diameter equivalent to the sidewalls, the outer portion further having a radius of curvature;

an inner recessed portion formed within the outer rounded portion, the inner recessed portion being generally ellipse shaped having an outer ellipse portion and an inner ellipse portion, the inner ellipse portion being recessed within the outer ellipse portion; the inner recessed portion having a first minor half and a second minor half forming a bottom portion wherein the first minor half and the second minor half are related by a predetermined proportion to the diameter; and an offset portion axially offset from the bottom portion, the offset portion forming a rib extending in the direction of the inner ellipse portion to resist deformation of the bottom.

22. The plastic molded container according to claim 21, wherein the radius of curvature is defined by a length of the inner ellipse portion.

23. The plastic molded container according to claim 21, wherein the container is a bottle or jar.

24. The plastic molded container according to claim 21, wherein the container holds a non-liquid material.

25. The plastic molded container according to claim 24, wherein the non-liquid material comprises approximately twenty percent of the volume of the plastic molded container.

26. The plastic molded container according to claim 24, wherein the non-liquid material is dry goods.

27. The plastic molded container according to claim 26, wherein the dry goods are food substances.

* * * * *